US008360013B2

(12) United States Patent
Kubo et al.

(10) Patent No.: US 8,360,013 B2
(45) Date of Patent: Jan. 29, 2013

(54) FUEL TANK SYSTEM

(75) Inventors: Yasuyuki Kubo, Wako (JP); Junichi Kamio, Wako (JP); Tadashi Kurotani, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 440 days.

(21) Appl. No.: 12/393,786

(22) Filed: Feb. 26, 2009

(65) Prior Publication Data

US 2009/0235908 A1 Sep. 24, 2009

(30) Foreign Application Priority Data

Mar. 19, 2008 (JP) ..... 2008-072328

(51) Int. Cl.
*F02B 63/00* (2006.01)

(52) U.S. Cl. ..... 123/2; 123/575; 123/1 A

(58) Field of Classification Search ..... 123/179.17, 123/179, 3, 179.4, 334.24, 179.16, 179.15, 123/179.14, 1 A, 1 R, 2; 701/110, 112, 22; 335/256, 220

See application file for complete search history.

(56) References Cited

U.S. PATENT DOCUMENTS

| | | | | |
|---|---|---|---|---|
| 4,133,847 | A * | 1/1979 | Feuerman | 261/18.2 |
| 4,210,103 | A * | 7/1980 | Dimitroff et al. | 123/1 A |
| 4,333,422 | A * | 6/1982 | Mahoney | 123/3 |
| 4,403,576 | A * | 9/1983 | Dimitroff et al. | 123/3 |
| 4,463,708 | A * | 8/1984 | Gerry | 123/25 E |
| 4,831,971 | A * | 5/1989 | Ott et al. | 123/25 A |
| 7,082,926 | B2 * | 8/2006 | Sadakane et al. | 123/431 |
| 7,159,568 | B1 * | 1/2007 | Lewis et al. | 123/431 |
| 7,290,505 | B2 * | 11/2007 | Kamio et al. | 123/1 A |
| 7,395,786 | B2 * | 7/2008 | Leone et al. | 123/1 A |
| 2006/0102136 | A1 * | 5/2006 | Bromberg et al. | 123/198 A |
| 2007/0012264 | A1 * | 1/2007 | Holt et al. | 123/1 A |
| 2007/0119394 | A1 * | 5/2007 | Leone | 123/25 R |
| 2007/0119416 | A1 * | 5/2007 | Boyarski | 123/304 |
| 2007/0234976 | A1 * | 10/2007 | Dearth et al. | 123/2 |
| 2008/0092851 | A1 * | 4/2008 | Arakawa et al. | 123/445 |

FOREIGN PATENT DOCUMENTS

| | | | |
|---|---|---|---|
| JP | 2006-132368 | A | 5/2006 |
| JP | 2007-46538 | A | 2/2007 |
| JP | 2007-56707 | A | 3/2007 |
| JP | 2007255322 | A * | 10/2007 |

* cited by examiner

*Primary Examiner* — Noah Kamen
*Assistant Examiner* — Long T Tran
(74) *Attorney, Agent, or Firm* — Birch, Stewart, Kolasch & Birch, LLP

(57) ABSTRACT

A system for separating an ethanol-gasoline blended fuel into gasoline and ethanol-water mixture by mixing water therewith with a lightweight, compact and simple configuration is provided. The system includes a fuel tank for storing a blended fuel; pump means for sucking the blended fuel in the fuel tank, separating the blended fuel into gasoline and ethanol-water mixture by mixing water therewith, and pressure-feeding the separated gasoline and ethanol-water mixture; a separation tank provided inside the fuel tank, and storing the gasoline and the ethanol-water mixture pressure-fed by the pump means in a state separated from each other and in a pressurized state; gasoline drawing means for drawing the gasoline stored in the separation tank via a first on-off valve; and ethanol drawing means for drawing the ethanol-water mixture stored in the separation tank via a second on-off valve.

15 Claims, 2 Drawing Sheets

FUEL TANK SYSTEM

BACKGROUND OF THE INVENTION

1. Field of the Invention

The present invention relates to a fuel tank system which stores an ethanol-gasoline blended fuel obtained by blending ethanol with gasoline.

2. Description of the Related Art

Recently, it has been studied that an ethanol-gasoline blended fuel is employed as an automobile fuel. Bioethanol obtained by fermentation and distillation of plant substances, for example, agricultural crops such as sugar cane and corn can be used as the ethanol. By properly managing soil, the plant substances can provide a so-called carbon neutral effect. The carbon neutral effect means that since a plant as a feedback in itself has already absorbed carbon dioxide, the amount of carbon dioxide to be emitted is equal to the amount of carbon dioxide absorbed by the plant itself when ethanol obtained from the plant substance is burned, and total emissions of carbon dioxide theoretically become zero. Accordingly, by using the ethanol-gasoline blended fuel as an automobile fuel, the emissions of carbon dioxide can be reduced, so as to contribute to the prevention of global warming.

When considered as a fuel, the ethanol has a high octane rating, and excellent anti-knocking properties in comparison with gasoline. Therefore, by using the ethanol as a fuel, knocking that limits the performance of an internal combustion engine can be suppressed.

However, in order to use only the ethanol as a fuel, high levels of ethanol is required, and also, the ethanol has less calorific value per unit volume than gasoline. Thus, the fuel consumption rate per unit volume could be deteriorated though thermal efficiency is improved by suppressing the knocking. Furthermore, since the ethanol is derived from plants, there is a limit to the amount of production.

Meanwhile, it is known that the knocking of an internal combustion engine occurs when the internal combustion engine is heavily loaded, and is unlikely to occur when the internal combustion engine is lightly loaded. Accordingly, by using the high levels of ethanol as a fuel only at the time of high load, the knocking can be efficiently suppressed.

Based on such an idea, the ratio of gasoline and ethanol supplied to the internal combustion engine may be controlled in accordance with a required load of the internal combustion engine by separating the ethanol-gasoline blended fuel into a gasoline and an ethanol-water mixture in an automobile by mixing water with the ethanol-gasoline blended fuel. For example, there is known a compression-ignition internal combustion engine for leading an oxygen containing gas and a fuel enabling compressed self-ignition into a cylinder and for compressing the same for self-ignition, the compression-ignition internal combustion engine being controlled by varying the supply of a blended fuel, the supply of a liquid hydrocarbon such as gasoline, and the supply of an ethanol-water mixture according to a required load of the compression-ignition internal combustion engine (see Japanese Patent Laid-Open No. 2006-132368).

Also, the present applicant filed a gasoline-ethanol separating apparatus comprising first to fourth fuel tanks, a water tank and first to fourth metering pumps as an apparatus for separating the ethanol-gasoline blended fuel into a gasoline and an ethanol-water mixture by mixing water with the ethanol-gasoline blended fuel in order to control the ratio of gasoline and ethanol supplied to the internal combustion engine according to the required load of the internal combustion engine as described above (see Japanese Patent Laid-Open No. 2007-46538).

The gasoline-ethanol separating apparatus comprises the water tank for storing water, the first fuel tank for storing the ethanol-gasoline blended fuel, the second fuel tank for separating the ethanol-gasoline blended fuel into the gasoline and the ethanol-water mixture by mixing water therewith, the third fuel tank for storing the separated gasoline, and the fourth fuel tank for storing the separated ethanol-water mixture. The gasoline-ethanol separating apparatus further comprises the first to fourth metering pumps for transferring liquid among the water tank and the respective first to fourth fuel tanks. In order to respectively draw the gasoline stored in the third fuel tank and the ethanol-water mixture stored in the fourth fuel tank and supply the same to the internal combustion engine, a metering pump is further required for each of the third and fourth fuel tanks. As a result, the gasoline-ethanol separating apparatus inevitably has a large weight.

The present applicant further proposed a gasoline-ethanol separating apparatus which intends to reduce its weight by controlling a pressure inside the water tank and the respective first to fourth fuel tanks instead of providing the metering pumps to supply fuel (see Japanese Patent Laid-Open No. 2007-56707).

Since the metering pumps are not used in the gasoline-ethanol separating apparatus which intends to reduce its weight, the entire apparatus can be reduced in weight. However, the gasoline-ethanol separating apparatus which intends to reduce its weight is not changed in that the apparatus comprises the five tanks of the water tank and the respective first to fourth fuel tanks, and the entire apparatus is inevitably of large size. Also, since liquid is transferred by use of a difference in internal pressure of the respective tanks, the control is inevitably complicated.

Accordingly, there is demanded a system capable of separating the ethanol-gasoline blended fuel into a gasoline and an ethanol-water mixture by mixing water with the ethanol-gasoline blended fuel with a lightweight, compact and simple configuration in order to be mounted on an automobile.

SUMMARY OF THE INVENTION

In view of such circumstances, it is an object of the present invention to provide a system capable of separating the ethanol-gasoline blended fuel into a gasoline and an ethanol-water mixture by mixing water with the ethanol-gasoline blended fuel with a lightweight, compact and simple configuration.

In order to achieve such an object, the present invention provides a fuel tank system that stores a blended fuel obtained by blending ethanol with gasoline as a fuel to be supplied to an internal combustion engine, and has a function of separating the blended fuel into a gasoline and an ethanol-water mixture by mixing water with the blended fuel, comprising: a fuel tank for storing the blended fuel; a pump means for sucking the blended fuel in the fuel tank, separating the blended fuel into the gasoline and the ethanol-water mixture by mixing water with the blended fuel, and pressure-feeding the separated gasoline and ethanol-water mixture; a separation tank provided inside the fuel tank, and storing the gasoline and the ethanol-water mixture pressure-fed by the pump means in a state separated from each other and in a pressurized state; a gasoline drawing means for drawing the gasoline out of the separation tank via a first on-off valve from above an interface between the gasoline and the ethanol-water mixture stored in the separation tank; and an ethanol drawing means for drawing the ethanol-water mixture stored in the separation tank out of the separation tank via a second on-off valve from below the interface.

According to the present invention, the blended fuel is sucked by the pump means and mixed with water in the pump means, so that the blended fuel is separated into the gasoline and the ethanol-water mixture. The separated gasoline and ethanol-water mixture are pressure-fed by the pump means and introduced into the separation tank provided inside the fuel tank.

In the separation tank, the gasoline and the ethanol-water mixture are stored in the state separated from each other, and are in the pressurized state by being pressure-fed by the pump means. The gasoline and the ethanol-water mixture are separated into upper and lower two layers due to a difference in specific gravity from each other in the separation tank. The ethanol-water mixture having a relatively large specific gravity is in the lower layer, and the gasoline having a relatively small specific gravity is in the upper layer.

Accordingly, the gasoline is drawn out of the separation tank by the gasoline drawing means via the first on-off valve from above the interface between the gasoline and the ethanol-water mixture in the separation tank. The ethanol-water mixture is drawn out of the separation tank by the ethanol drawing means via the second on-off valve from below the interface between the gasoline and the ethanol-water mixture in the separation tank.

According to the present invention, the pump means transfers and mixes the blended fuel and water, and transfers the separated gasoline and ethanol-water mixture. Also, the separation tank is provided inside the fuel tank. Therefore, the entire fuel tank system can have a lightweight, compact and simple configuration.

In the present invention, the first on-off valve may be first fuel injection means for injecting the gasoline into the internal combustion engine, for example, and the second on-off valve may be second fuel injection means for injecting the ethanol-water mixture into the internal combustion engine, for example. In this case, since the gasoline and the ethanol-water mixture are stored in the pressurized state in the separation tank, the gasoline and the ethanol-water mixture can be injected into the internal combustion engine only by opening the first or second fuel injection means.

In the present invention, the pump means is preferably provided inside the fuel tank. Accordingly, the entire fuel tank system can be further reduced in size.

In the present invention, a water tank is preferably provided inside the fuel tank, to supply water stored in the water tank to the pump means. The water stored in the water tank may be condensation of moisture contained in an exhaust gas of the internal combustion engine, for example.

In the present invention, when the water stored in the water tank is supplied to the pump means, the water is preferably supplied via a control valve. In this case, the control valve is closed after a predetermined amount of water is supplied to the pump means. The pump means mixes the predetermined amount of water with the blended fuel, pressure-feeds the separated gasoline and ethanol-water mixture to the separation tank, and pressure-feeds only the blended fuel to the separation tank after the control valve is closed.

In the separation tank, the gasoline and the ethanol-water mixture are separated into two layers, and the ethanol-water mixture is in the lower layer as described above. By introducing the blended fuel pressure-fed by the pump means into the separation tank from below the interface between the gasoline and the ethanol-water mixture in the separation tank, the blended fuel is mixed with water in the ethanol-water mixture, to be separated into the gasoline and the ethanol-water mixture in the separation tank.

In this case, since the water contained in the ethanol-water mixture is reduced with time, the control valve is opened and a predetermined amount of water is supplied to the pump means again when the ratio of water falls under a minimum threshold for separating the blended fuel into the gasoline and the ethanol-water mixture. The water contained in the ethanol-water mixture may be measured by providing an ethanol sensor in the ethanol drawing means, or by providing an ethanol sensor below the interface between the gasoline and the ethanol-water mixture in the separation tank, for example.

The control valve may be opened and closed upon reception of an output signal from the respective ethanol sensors. In this case, when the water contained in the ethanol-water mixture detected by the ethanol sensor exceeds a predetermined maximum threshold, the control valve is closed by determining that excessive water is supplied.

In the present invention, when the gasoline and the ethanol-water mixture are disproportionately consumed, the amounts of the gasoline and the ethanol-water mixture stored in the separation tank may become unequal. Accordingly, in the present invention, it is preferable to provide an interface sensor for detecting the interface between the gasoline and the ethanol-water mixture in the separation tank, and an gasoline reflux means for refluxing the gasoline stored in the separation tank to the fuel tank via a third on-off valve from above the interface when the interface detected by the interface sensor is lower than a predetermined position. Because of the feature, when the amount of the gasoline stored in the separation tank becomes excessive, the gasoline can be refluxed to the fuel tank by the gasoline reflux means, and the amount of the ethanol-water mixture stored in the separation tank can be increased by promoting the separation of the blended fuel to compensate for a decrease in the gasoline.

In the present invention, when the interface detected by the interface sensor is higher than a predetermined position, the consumption of the ethanol-water mixture can be promoted by increasing the amount of the ethanol-water mixture to be injected into the internal combustion engine from the second fuel injection means. At this point, the blended fuel stored in the fuel tank may be directly injected into the internal combustion engine from the first fuel injection means.

DETAILED DESCRIPTION OF THE PREFERRED EMBODIMENTS

Next, an embodiment of the present invention will be described in further detail with reference to the accompanying drawings.

Figure 1:
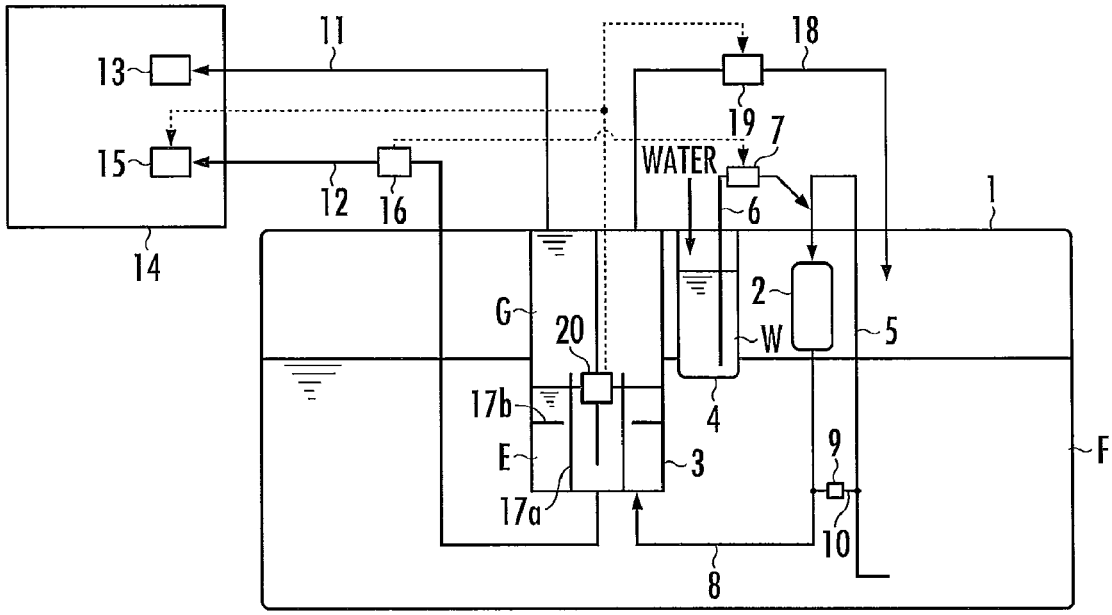
FIG. 1 is an explanatory cross-sectional view showing a first aspect of a fuel tank system according to the present invention.

A fuel tank system according to the present embodiment is mounted on an automobile. A first aspect thereof comprises a fuel tank 1 for storing an ethanol-gasoline blended fuel F, a pump 2, a separation tank 3 and a water tank 4 as shown in FIG. 1. The pump 2, the separation tank 3 and the water tank 4 are all included in the fuel tank 1.

The pump 2 comprises a suction pipe 5 that opens in the fuel tank 1 and sucks the ethanol-gasoline blended fuel F. A water pipe 6 for supplying water W stored in the water tank 4 to the pump 2 is connected to the suction pipe 5 via a control valve 7. The pump 2 also comprises a pressure feed pipe 8 for pressure-feeding a gasoline and an ethanol-water mixture separated from the ethanol-gasoline blended fuel F to the separation tank 3 by mixing the water W with the ethanol-gasoline blended fuel F inside the pump 2. The pressure feed pipe 8 is connected to the outer peripheral side of the bottom surface of the separation tank 3. Furthermore, the pressure feed pipe 8 comprises a relief line 10 that is connected to the suction pipe 5 via a back pressure valve 9.

The separation tank 3 stores a gasoline G and an ethanol-water mixture E pressure-fed by the pump 2 in a state separated from each other and in a pressurized state. When a pressure inside the separation tank 3 becomes excessive, the back pressure valve 9 provided in the relief line 10 is opened, so that the gasoline G and the ethanol-water mixture E, or the ethanol-gasoline blended fuel F introduced from the pressure feed pipe 8 can be refluxed to the pump 2 via the suction pipe 5.

The separation tank 3 comprises a gasoline drawing pipe 11 for drawing the gasoline G out of the separation tank 3, and an ethanol drawing pipe 12 for drawing the ethanol-water mixture E out of the separation tank 3. The gasoline drawing pipe 11 opens in the top surface of the separation tank 3, and is connected to an engine 14 via a first injector 13 that functions as a first on-off valve.

The ethanol drawing pipe 12 opens in the center portion of the bottom surface of the separation tank 3, and is connected to the engine 14 via a second injector 15 that functions as a second on-off valve. The ethanol drawing pipe 12 comprises an ethanol sensor 16 on the upstream side from the second injector 15. The ethanol sensor 16 calculates the ratio of water contained in the ethanol-water mixture E by detecting the ratio of ethanol contained in the ethanol-water mixture E that is circulated in the ethanol drawing pipe 12, and controls opening and closing of the control valve 7 provided in the water pipe 6 based on the calculated ratio of water.

A partition plate 17*a* for preventing the ethanol-gasoline blended fuel F from flowing into the ethanol drawing pipe 12 without being separated when the ethanol-gasoline blended fuel F is introduced from the pressure feed pipe 8, and a partition plate 17*b* for promoting the separation into the gasoline G and the ethanol-water mixture E by suppressing the ethanol-gasoline blended fuel F introduced from the pressure feed pipe 8 from moving upward in the separation tank 3 are provided inside the separation tank 3. The partition plate 17*a* is vertically provided so as to enclose the periphery of an opening of the ethanol drawing pipe 12 between an opening of the pressure feed pipe 8 and the opening of the ethanol drawing pipe 12. The partition plate 17*b* is horizontally provided with a predetermined interval from the outer peripheral side of the partition plate 17*a*.

The separation tank 3 also comprises a reflux pipe 18 for refluxing the gasoline G to the fuel tank 1 as required. The ref lux pipe 18 opens in the top surface of the separation tank 3, and is connected to the fuel tank 1 via a control valve 19. The separation tank 3 further comprises a float sensor 20 for detecting an interface between the gasoline G and the ethanol-water mixture E therein. The float sensor 20 detects the interface to control opening and closing of the control valve 19 that is provided in the reflux pipe 18 and the second injector 15 that is provided in the ethanol drawing pipe 12 based on the height of the interface.

The water tank 4 stores condensed water obtained by condensing moisture contained in an exhaust gas of the engine 14, for example.

Next, the operation of the fuel tank system shown in FIG. 1 will be described.

In the fuel tank system shown in FIG. 1, the pump 2 is activated first, so that the ethanol-gasoline blended fuel F stored in the fuel tank 1 is introduced into the pump 2 via the suction pipe 5. At the same time, the control valve 7 provided in the water pipe 6 is opened and closed, to supply a predetermined amount of water W from the water tank 4 to the pump 2.

The ethanol-gasoline blended fuel F is mixed with the water W in the pump 2, to be separated into the gasoline G and the ethanol-water mixture E. The separated gasoline G and ethanol-water mixture E are introduced into the separation tank 3 via the pressure feed pipe 8. The gasoline G and the ethanol-water mixture E separated as described above are in a mutually suspended form in the pressure feed pipe 8. When introduced into the separation tank 3, the gasoline G and the ethanol-water mixture E are separated into upper and lower two layers in accordance with a difference in specific gravity while moving upward along the partition plates 17*a* and 17*b*. As a result, the ethanol-water mixture E having a relatively large specific gravity is in the lower layer, and the gasoline G having a relatively small specific gravity is in the upper layer in the separation tank 3.

The gasoline G and the ethanol-water mixture E separated as described above is stored in the pressurized state in the separation tank 3 by the pressure of the pump 2. When the pressure inside the separation tank 3 becomes excessive, the control valve 9 provided in the relief line 10 is opened, to reflux the gasoline G and the ethanol-water mixture E, or the ethanol-gasoline blended fuel F to the pump 2 via the suction pipe 5. Since the ethanol-water mixture E is refluxed to the pump 2 via the suction pipe 5, it is possible to prevent water from being mixed into the fuel tank 1.

The gasoline G and the ethanol-water mixture E stored in the separation tank 3 are injected from the injectors 13 and 15 at a predetermined ratio in accordance with a required load of the engine 14. Since the gasoline G and the ethanol-water mixture E are in the pressurized state as described above, the gasoline G and the ethanol-water mixture E are injected into the engine 14 only by opening the injector 13 or 15.

When the gasoline G or the ethanol-water mixture E is consumed by being injected into the engine 14 as described above, new gasoline G and ethanol-water mixture E are introduced into the separation tank 3 via the pressure feed pipe 8 to compensate for an amount consumed. When the control valve 7 provided in the water pipe 6 is closed, the ethanol-gasoline blended fuel F is directly introduced into the separation tank 3 via the pressure feed pipe 8. Since the ethanol-water mixture E exists in the lower portion of the separation tank 3, the ethanol-gasoline blended fuel F is mixed with water contained in the ethanol-water mixture E, to be separated into the gasoline G and the ethanol-water mixture E.

The ratio of water contained in the ethanol-water mixture E is monitored by the ethanol sensor 16 provided in the ethanol drawing pipe 12. When the ratio of water falls below a minimum threshold for separating the ethanol-gasoline blended fuel F into the gasoline G and the ethanol-water mixture E, the ethanol sensor 16 opens and closes the control valve 7 provided in the water pipe 6 to supply a predetermined amount of water W to the pump 2 again.

In the fuel tank system of the present embodiment, the gasoline G and the ethanol-water mixture E are injected from the injectors 13 and 15 at a predetermined ratio in accordance with the required load of the engine 14 as described above. When the required load of the engine 14 is large, the injection amount of the ethanol-water mixture E is increased. When the required load of the engine 14 is small, the injection amount of the gasoline G is increased. If the required load of the engine 14 continues to be large or small for a long period of time, the gasoline G and the ethanol-water mixture E are disproportionately consumed, and the amounts of the gasoline G and the ethanol-water mixture E stored in the separation tank 3 may become unequal.

Accordingly, in the fuel tank system of the present embodiment, the float sensor 20 provided inside the separation tank 3 monitors the interface between the gasoline G and the ethanol-water mixture E. When the interface becomes higher or lower than a predetermined position, the float sensor 20 equalizes the amounts of the gasoline G and the ethanol-water mixture E stored in the separation tank 3.

To be more specific, when detecting that the interface becomes lower than a predetermined position, the float sensor 20 determines that the amount of the gasoline G stored in the separation tank 3 is excessive, and refluxes the gasoline G to the fuel tank 1 by opening the control valve 19 provided in the reflux pipe 18. Accordingly, the gasoline G and the ethanol-water mixture E, or the ethanol-gasoline blended fuel F is supplied to the separation tank 3 via the pressure feed pipe 8 to compensate for a decrease in the refluxed gasoline G. The amount of the ethanol-water mixture E stored in the separation tank 3 can be thereby increased.

On the other hand, when detecting that the interface becomes higher than a predetermined position, the float sensor 20 determines that the amount of the ethanol-water mixture E stored in the separation tank 3 is excessive, and increases the amount of the ethanol-water mixture E to be injected into the engine 14 from the second injector 15. As a result, the amount of the ethanol-water mixture E stored in the separation tank 3 can be reduced by promoting the consumption of the ethanol-water mixture E.

Next, a second aspect of the fuel tank system of the present embodiment will be described with reference to FIG. 2.

The fuel tank system according to the second aspect has exactly the same configuration as the fuel tank system according to the first aspect shown in FIG. 1 except that the fuel tank system comprises an ethanol sensor 21 below the interface between the gasoline G and the ethanol-water mixture E in the separation tank 3 in addition to the configuration shown in FIG. 1.

Figure 2:
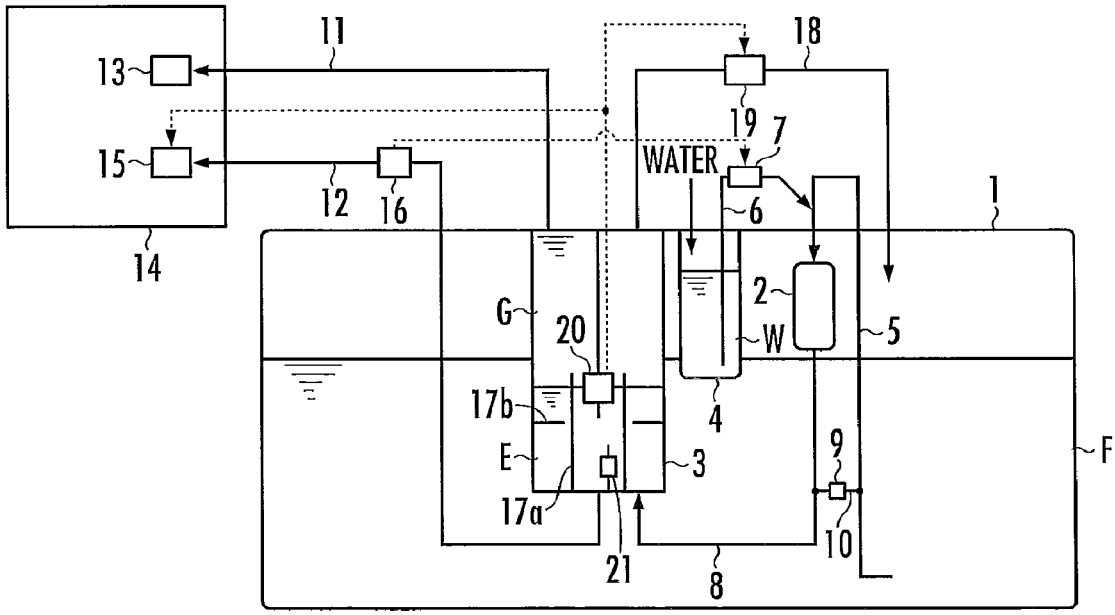
FIG. 2 is an explanatory cross-sectional view showing a second aspect of a fuel tank system according to the present invention.

In the fuel tank system according to the second aspect shown in FIG. 2, the ethanol sensor 16 provided in the ethanol drawing pipe 12 monitors the ratio of water contained in the ethanol-water mixture E. When the ratio of water falls below the minimum threshold for separating the ethanol-gasoline blended fuel F into the gasoline G and the ethanol-water mixture E, the ethanol sensor 16 opens the control valve 7 provided in the water pipe 6 to supply the water W stored in the water tank 4 to the pump 2.

Meanwhile, in the fuel tank system according to the second aspect shown in FIG. 2, the ethanol sensor 21 provided inside the separation tank 3 also monitors the ratio of water contained in the ethanol-water mixture E. When the ratio of water exceeds a predetermined maximum threshold, the ethanol sensor 21 closes the control valve 7 provided in the water pipe 6 to stop supplying water to the pump 2 by determining that excessive water is supplied.

A flow switch that moves up and down depending on the specific gravity of the ethanol-water mixture E can be employed as the ethanol sensor 21, for example. The flow switch has the same specific gravity as that of the ethanol-water mixture E stored in the separation tank 3, and is configured to be turned ON by rising when the water in the ethanol-water mixture E exceeds the maximum threshold and the specific gravity of the ethanol-water mixture E is greater than a predetermined specific gravity.

Figure 3:
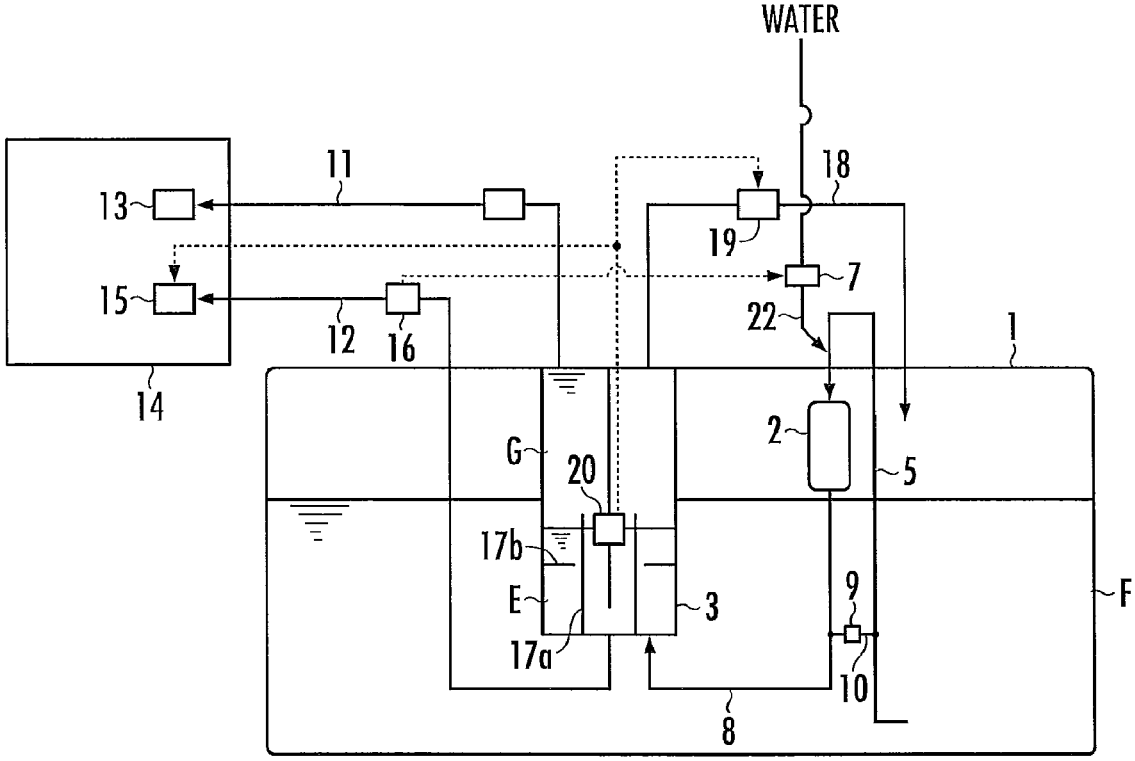
FIG. 3 is an explanatory cross-sectional view showing a third aspect of a fuel tank system according to the present invention.

Next, a third aspect of the fuel tank system of the present embodiment will be described with reference to FIG. 3.

The fuel tank system according to the third aspect has exactly the same configuration as the fuel tank system according to the first aspect shown in FIG. 1 except that the condensed water obtained by condensing moisture contained in the exhaust gas of the engine 14 is directly supplied to the pump 2 by a water pipe 22 instead of the water tank 4 shown in FIG. 1. The water pipe 22 is connected to the suction pipe 5 via the control valve 7, and the control valve 7 performs the same operation as that of the fuel tank system according to the first aspect shown in FIG. 1.

What is claimed is:

1. A fuel tank system that stores a blended fuel obtained by blending ethanol with gasoline as a fuel to be supplied to an internal combustion engine, comprising:

a fuel tank for storing the blended fuel;

a pump configured to suck the blended fuel in the fuel tank, mix water with the blended fuel sucked by the pump, separate the blended fuel mixed with the water into the gasoline and an ethanol-water mixture, and pressure-feed the separated gasoline and ethanol-water mixture;

a separation tank provided inside the fuel tank, and storing the gasoline and the ethanol-water mixture pressure-fed by the pump in a state separated from each other and in a pressurized state;

a gasoline drawing device configured to draw the gasoline out of the separation tank via a first on-off valve from above an interface between the gasoline and the ethanol-water mixture stored in the separation tank; and an ethanol drawing device configured to draw the ethanol-water mixture stored in the separation tank out of the separation tank via a second on-off valve from below the interface, wherein the pump is located inside the fuel tank and is located fully outside the separation tank.

2. The fuel tank system according to claim 1, wherein the first on-off valve is a first injector configured to inject the gasoline into the internal combustion engine, and the second on-off valve is a second injector configured to inject the ethanol-water mixture into the internal combustion engine.

3. The fuel tank system according to claim 1, wherein the pump device is provided inside the fuel tank.

4. The fuel tank system according to claim 1, further comprising a control valve configured to supply the water into the blended fuel.

5. The fuel tank system according to claim 4, wherein a water tank for storing the water is provided inside the fuel tank.

6. The fuel tank system according to claim 4, further comprising a water detecting device configured to detect water contained in the ethanol-water mixture and controlling opening and closing of the control valve in accordance with a detected amount of water.

7. The fuel tank system according to claim 6, wherein the water detecting device is an ethanol sensor provided in the ethanol drawing device.

8. The fuel tank system according to claim 6, wherein the water detecting device is an ethanol sensor provided in the ethanol-water mixture stored in the separation tank.

9. The fuel tank system according to claim 4, wherein the control valve supplies the water into the blended fuel before the blended fuel enters into the pump.

10. The fuel tank system according to claim 1, further comprising an interface sensor configured to detect the interface between the gasoline and the ethanol-water mixture stored in the separation tank.

11. The fuel tank system according to claim 10, further comprising a reflux device configured to reflux the gasoline stored in the separation tank to the fuel tank when the interface detected by the interface sensor is lower than a predetermined position.

12. The fuel tank system according to claim 10, wherein an amount of the ethanol-water mixture to be injected into the internal combustion engine from the second injector is increased when the interface detected by the interface sensor is higher than a predetermined position.

13. The fuel tank system according to claim 1, wherein the fuel tank system is mounted on an automobile.

14. The fuel tank system according to claim 1, further comprising a suction pipe, a control valve, and a water pipe connected to the suction pipe via the control valve, wherein the pump sucks the blended fuel in the fuel tank via the suction pipe, and the water is added into the blended fuel in the suction pipe via the water pipe and the control valve before the blended fuel enters into the pump.

15. A fuel tank system that stores a blended fuel obtained by blending ethanol with gasoline as a fuel to be supplied to an internal combustion engine, comprising:

a fuel tank for storing the blended fuel;

a pump configured to suck the blended fuel in the fuel tank, mix water with the blended fuel sucked by the pump, separate the blended fuel mixed with the water into the gasoline and an ethanol-water mixture, and pressure-feed the separated gasoline and ethanol-water mixture;

a separation tank provided inside the fuel tank, and storing the gasoline and the ethanol-water mixture pressure-fed by the pump in a state separated from each other and in a pressurized state;

a gasoline drawing device configured to draw the gasoline out of the separation tank via a first on-off valve from above an interface between the gasoline and the ethanol-water mixture stored in the separation tank;

an ethanol drawing device configured to draw the ethanol-water mixture stored in the separation tank out of the separation tank via a second on-off valve from below the interface; and a pressure feed pipe extending from an outlet of the pump to an inlet of the separation tank to feed the separated gasoline and ethanol-water mixture from the pump into the separation tank, wherein the pressure feed pipe is located inside the fuel tank and is located fully outside the separation tank.

* * * * *